United States Patent [19]

Rosendale

[11] Patent Number: 4,890,605

[45] Date of Patent: Jan. 2, 1990

[54] CERVICAL TRACTION DEVICE

[76] Inventor: Robert W. Rosendale, 181 Barnsbury Rd., Langhorne, Pa. 19047

[21] Appl. No.: 128,610

[22] Filed: Dec. 4, 1987

[51] Int. Cl.[4] ..... A61H 1/02

[52] U.S. Cl. ..... 128/75; 128/84 C

[58] Field of Search ..... 128/70, 71, 75, 76 R, 128/84 C; 272/130, 134, 137, 138, 139, 143, DIG. 5; 269/328; 5/508, 82 R

[56] References Cited

U.S. PATENT DOCUMENTS

| | | | |
|---|---|---|---|
| 1,119,813 | 12/1914 | De Tar | 128/84 C |
| 1,580,507 | 4/1926 | Lidgett | 128/84 C |
| 1,968,120 | 7/1934 | Barghausen | 269/328 |
| 2,259,757 | 10/1941 | Longfellow | 128/84 C |
| 2,262,271 | 11/1941 | De Camp | 128/71 |
| 2,837,085 | 6/1958 | Tong | 128/75 |
| 2,853,999 | 9/1958 | Risser | 128/84 C |
| 3,009,461 | 11/1961 | Collins | 128/75 |
| 3,020,909 | 2/1962 | Stevens | 128/70 |
| 3,139,883 | 7/1964 | Collins | 128/75 |
| 3,477,428 | 11/1969 | Hare | 128/75 |
| 3,662,750 | 5/1972 | Jorgensen | 128/75 |
| 3,663,972 | 5/1972 | Denton | 128/75 X |
| 3,732,863 | 5/1973 | Harrington | 128/84 C |
| 3,811,433 | 5/1974 | Brachet | 128/84 C |
| 3,868,951 | 3/1975 | Albrecht | 128/75 |
| 4,114,611 | 9/1978 | Lyle et al. | 128/75 |
| 4,257,410 | 3/1981 | Flewelling | 128/75 |
| 4,444,179 | 4/1984 | Trippi | 128/75 |
| 4,489,715 | 12/1984 | Hall | 128/75 |
| 4,492,375 | 1/1985 | Connelly | 272/143 |
| 4,649,907 | 3/1987 | Whitehead et al. | 128/84 C |

FOREIGN PATENT DOCUMENTS

| | | | |
|---|---|---|---|
| 2814178 | 10/1978 | Fed. Rep. of Germany | 269/328 |

OTHER PUBLICATIONS

Braces; Braces Today; Newsletter of Pope Foundation; 2/58, Head Traction Device, 4 pages.

Woods; Isothermic Exercise Equipment; 4/1964, by W. J. Voit Rubber Corp.

Radford; Radford Equitorq, cervical spine traction, 4 pages; 9/65; by J. C. Radford ©1964.

*Primary Examiner*—Edgar S. Burr

*Assistant Examiner*—Moshe I. Cohen

*Attorney, Agent, or Firm*—John F. A. Earley; John F. A. Earley, III; P. Michael Walker

[57] ABSTRACT

A cervical traction device for use with a stretcher, especially with the type of stretcher that is used for transporting trauma patients with spinal cord injuries by helicopter, for providing traction to an injured person having a fractured neck comprises a frame, attachment members for attaching the frame to the stretcher, a traction device mounted on the frame for applying traction to the cervical spine of the injured person and for adjusting said traction, and vertical adjustment apparatus for adjustably securing the traction device at a desired position on the frame to allow height adjustment of the traction device to obtain proper traction alignment with the injured person lying on the stretcher.

6 Claims, 5 Drawing Sheets

CERVICAL TRACTION DEVICE

BACKGROUND OF THE INVENTION

1. Field of the Invention

This invention relates to traction devices, and more particularly to a cervical traction device for use with a stretcher, especially with the type of stretcher that is used for transporting trauma patients with spinal cord injuries by helicopter, for providing traction to a person having a fractured neck.

2. Description of the Prior Art

It is common practice to provide traction to an accident victim suffering from an injury to the spine or the neck. Providing immediate traction to such an accident victim alleviates pain and prevents further injury during transportation to a hospital.

It is often desirable to transport such accident victims from the scene of the accident or from one hospital to another hospital by helicopter, but transportation by helicopter is restricted by weight and space limitations.

Many of the known traction devices use some sort of free weight mechanisms, which are clumsy, bulky and not adapted for use in a helicopter. Others are heavy or require heavy weights, or are very complex and expensive.

Further, the known traction devices do not provide for adjustment of the direction of the pull or traction so that a straight pull on the spine may be accomplished for every accident victim, and the known devices use complex means for applying and adjusting traction.

SUMMARY OF THE INVENTION

It is an object of this invention to provide a new cervical traction device that is simple to use, lightweight, and compact, making it ideal for use in helicopters.

Another object is to provide a new cervical traction device that is durable and inexpensive.

Another object is to provide a new cervical traction device that allows the amount of traction to be monitored and easily adjusted during transportation.

Another object is to provide a new cervical traction device which may also be used in ambulances and hospitals.

Still another object is to provide a new cervical traction device having an adjustment feature whereby the direction of the pull or traction may be adjusted so that a straight pull on the spine may be accomplished for every accident victim.

These and other objects are accomplished by providing a cervical traction device for use with a stretcher, especially with the type of stretcher that is used for transporting trauma patients with spinal cord injuries by helicopter, for providing traction to the person having a fractured neck, that comprises a frame, attachment means for attaching the frame to a stretcher, traction means mounted on the frame adapted to be connected to a patient to apply traction, and vertical adjustment means for adjustably securing the traction means at a desired position to allow vertical height adjustment of the traction means to obtain proper traction alignment with the injured person lying on the stretcher.

DETAILED DESCRIPTION

Figure 1:
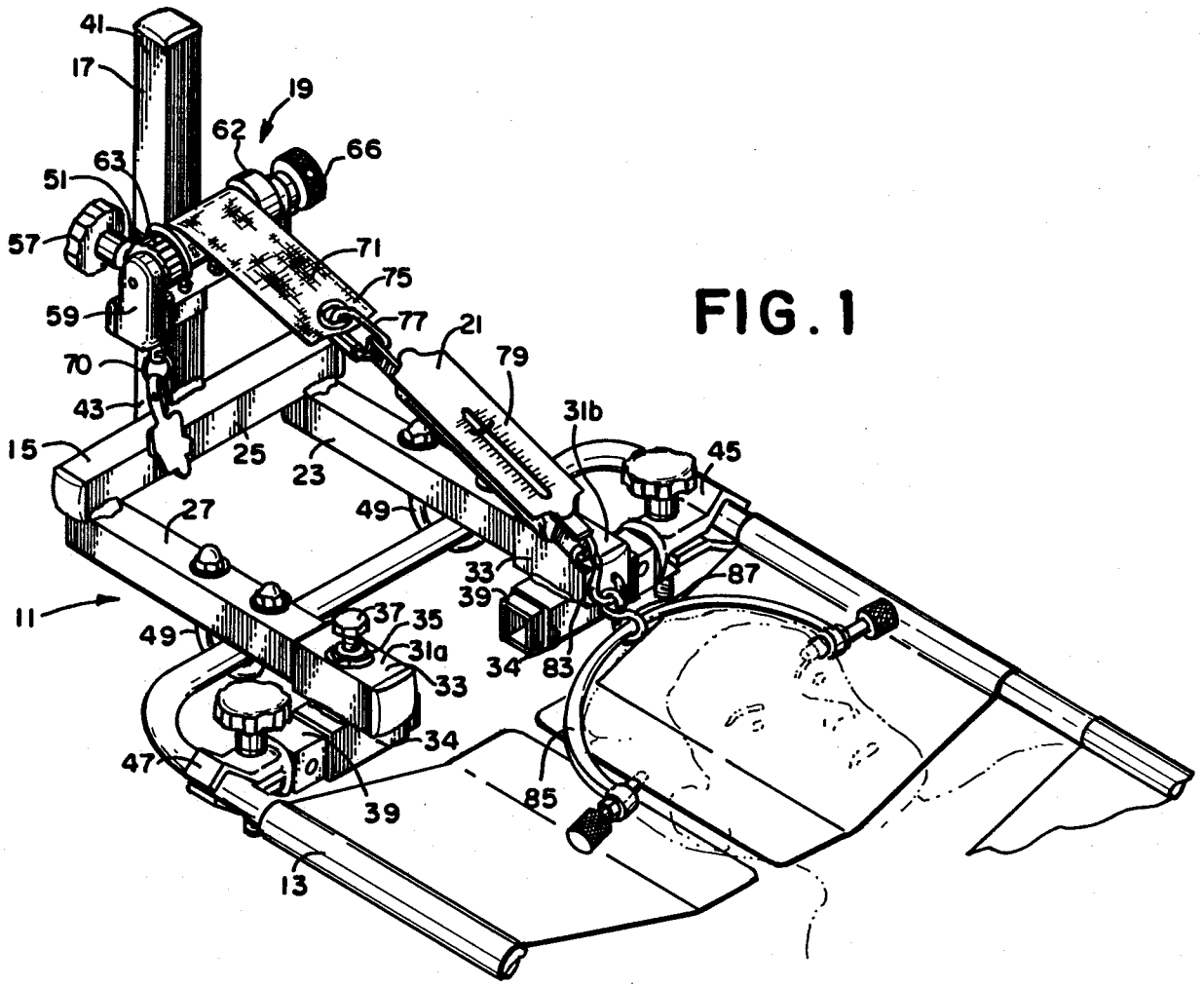
FIG. 1 is a view in perspective of a cervical traction device constructed in accordance with this invention.

Turning to the drawings, there is shown a cervical traction device 11 for use with a stretcher 13, especially with the type stretcher that is used for transporting trauma patients with spinal cord injuries by helicopter, for providing traction to a person having a fractured neck. Cervical traction device 11 comprises a frame 15 that is mounted on stretcher 13, and has a vertical bar 17 mounted on and extending upwardly from a U-shaped portion. Traction means for applying traction on the cervical spine of the injured person and for adjusting the amount of this traction includes a ratchet device 19 and a measuring device 21 for measuring the amount of traction being applied by the ratchet device 19 to the cervical spine of the injured person.

Frame 15 includes hollow aluminum bars 23, 25 and 27 that are welded together to form a U-shape with bars 23, 27 being parallel to each other to form the legs of the U and being joined together by base bar 25.

Sleeve devices **31*a*, 31*b* include a sleeve 33 and a sleeve 34 welded at right angles to sleeve 33**.

Sleeve 33 of sleeve device **31*a* is slid onto the foot of leg 27 and is adjustably positioned thereon by a bolt 37 which is threaded through a nut 35 mounted on sleeve 33 so that the end of the bolt 37 contacts the surface of leg 27 to hold the sleeve 33 in a desired position. Similarly, sleeve 33 of sleeve device 31*b* is slid onto the foot of leg 23 and is adjustably positioned thereon by a bolt 37 which is threaded through a nut 35 mounted on sleeve 33 so that the end of bolt 37 frictionally contacts the surface of leg 23 to hold sleeve 33** in a desired position.

A bar 39 extends laterally outwardly from each sleeve device **31*a*, 31*b* and is slideably mounted in sleeve 34 and adjustably positioned therein by bolts 37*a* which extend through nuts 35*a* to press against the under surface of bar 39 to adjustably hold bar 39** in a desired position.

A first clamp 45 extends laterally outwardly from bar 39 of sleeve device **31*b* for attaching the frame 15 to a side rail of stretcher 13, and a second clamp 47 extends laterally outwardly from bar 39 of sleeve device 31*a* for attaching the frame 15 to the other side rail of the stretcher 13**.

Vertical bar 17 is preferably hollow and made from aluminum, and has a first end portion 41 and a second end portion 43, the second end portion 43 of vertical bar 17 being welded to the center portion of bar 25.

A pair of U-bolts and nuts 49 are provided on frame 15 that engage the head rail of stretcher 13 and clamp the legs 23, 27 of frame 15 to the head rail of the stretcher 13 to increase the stability of the cervical traction device 11.

Ratchet device 19 is bolted to a plate 50 welded to a sleeve 51 which is slideably positioned on vertical bar 17. Sleeve 51 is adjustably positioned on vertical bar 17 by a threaded bolt 55 which is screwed through nut 53 mounted on sleeve 51 into pressing contact with vertical bar 17 to secure the sleeve 51 and the ratchet device 19 at the desired vertical height on vertical bar 17 to obtain proper traction alignment with the injured person lying on stretcher 13. To facilitate adjusting the position of sleeve 51 on vertical bar 17 so that ratchet device 19 is properly aligned with the patient, threaded bolt 55 is provided with a knob or handle 57 at its outer end to aid in quickly tightening and untightening bolt 55.

Ratchet device 19 includes a bracket 59, with a horizontal shaft or rod 61 mounted between the arms of the bracket 59 such that the rod 61 is adapted to spin or rotate around its own longitudinal central axis. A spool 62 is mounted on shaft 61, and a ratchet wheel 63, having teeth 65 on its outer circumference, is formed on one flange of the spool 62. To facilitate turning or rotation of ratchet wheel 63, rod 61 is provided with a knob or handle 66. A movable pin 67 is also mounted on bracket 59 and is held in contact with the teeth 65 of ratchet wheel 63 by a spring 69 that is housed in bracket 59. Pin 67 is provided with a ring 70 to facilitate pulling pin 67 out when it is desired to disengage pin 67 from contact with ratchet wheel 63 to allow rotation of wheel 63.

A nylon strap 71 has a first end portion 73 which is bolted to spool 62 of ratchet device 19 so that nylon strap 71 may be wound onto and unwound from spool 62 when spool 62 is rotated, and a second end portion 75 which is connected to measuring device 21 by a connecting ring 77.

Figure 7:
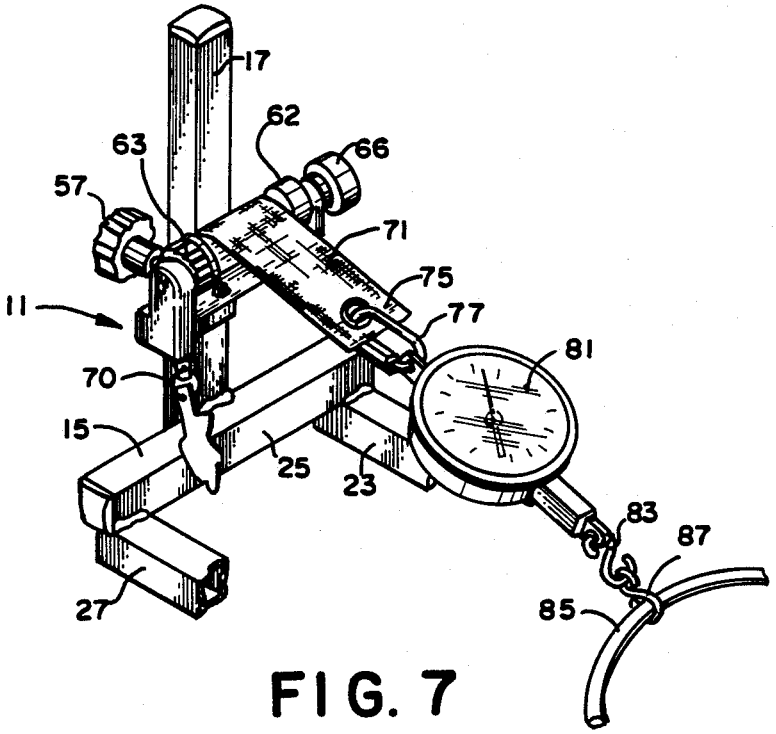
FIG. 7 is a partial view in perspective of an alternative embodiment of the invention.

Measuring device 21 is a standard spring-loaded weight scale 79. Alternatively, as shown in FIG. 7, a standard dial scale 81 may be used in place of the scale 79 for measuring the traction applied to the cervical spine of the patient.

S-hooks 83, 87 are mounted at the end of measuring device 21 so that cervical traction device 11 is easily connected to a tong 85 that is secured to the head of the patient lying on stretcher 13.

In operation, the cervical traction device 11 is attached to the stretcher 13 by securing the U-bolts 49 to the head rail of the stretcher 13 and by fastening clamps 45, 47 to the side rails of the stretcher 13. With cervical traction device 11 mounted on stretcher 13 and attached to an injured person, traction may be provided to the spinal cord of the injured person secured to stretcher 13 by turning the handle 66 of ratchet device 19 to pull nylon strap 71 taut.

Proper traction alignment is obtained by adjusting the vertical position of ratchet device 19 on vertical bar 17 so that a straight pulling action on the cervical spine is accomplished. Accordingly, the medical attendant administering traction with cervical traction device 11 to the spine of the injured person first determines the direction in which the cervical spine of the particular injured person lying on the stretcher 13 is pointing, and then adjusts the height of ratchet device 19 on vertical bar 17 such that the nylon strap 71 is aligned or angled to pull in the same direction as the spine is aligned. In other words, ratchet device 19 is positioned on vertical bar 17 such that the angle between the nylon strap 71 and vertical bar 17 is the same as the angle between the cervical spine of the injured person and vertical bar 17.

Traction is applied to the cervical spine of the person lying on stretcher 13 by turning handle 66 to rotate shaft 61 which winds nylon strap 71 around spool 62, thereby creating a pulling action on the spine.

Figure 2:
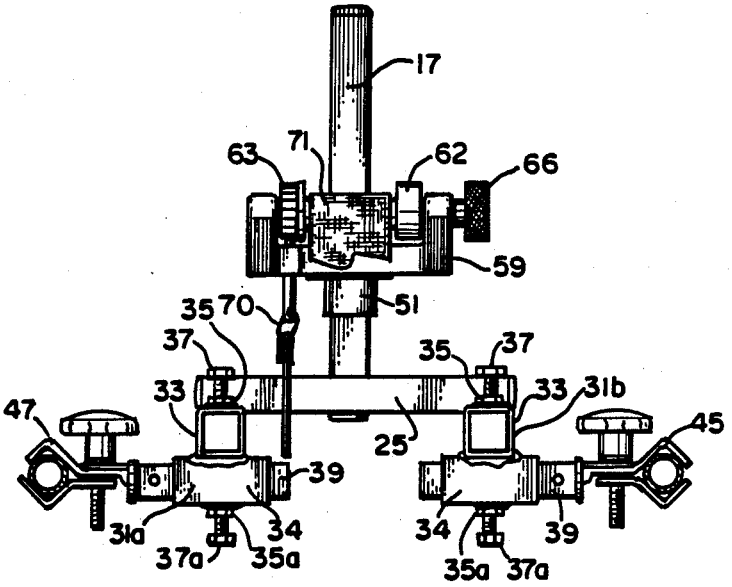
FIG. 2 is a partial front view in elevation of the invention.
Figure 3:
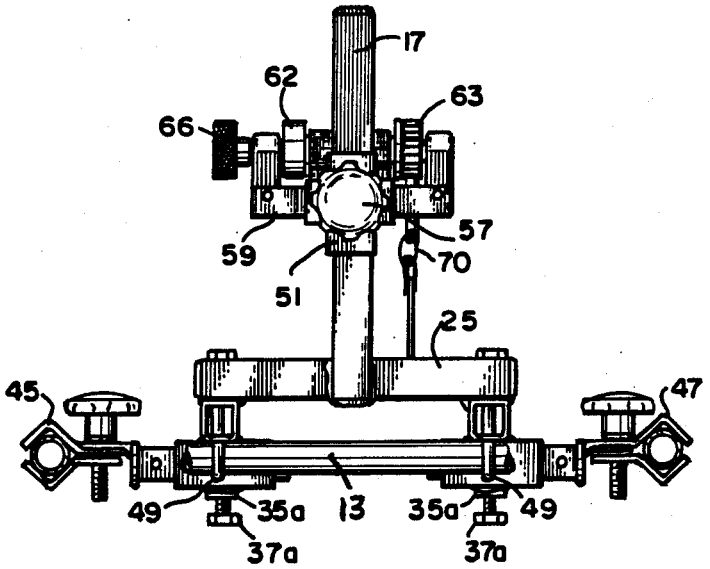
FIG. 3 is a rear view in elevation of the invention.
Figure 4:
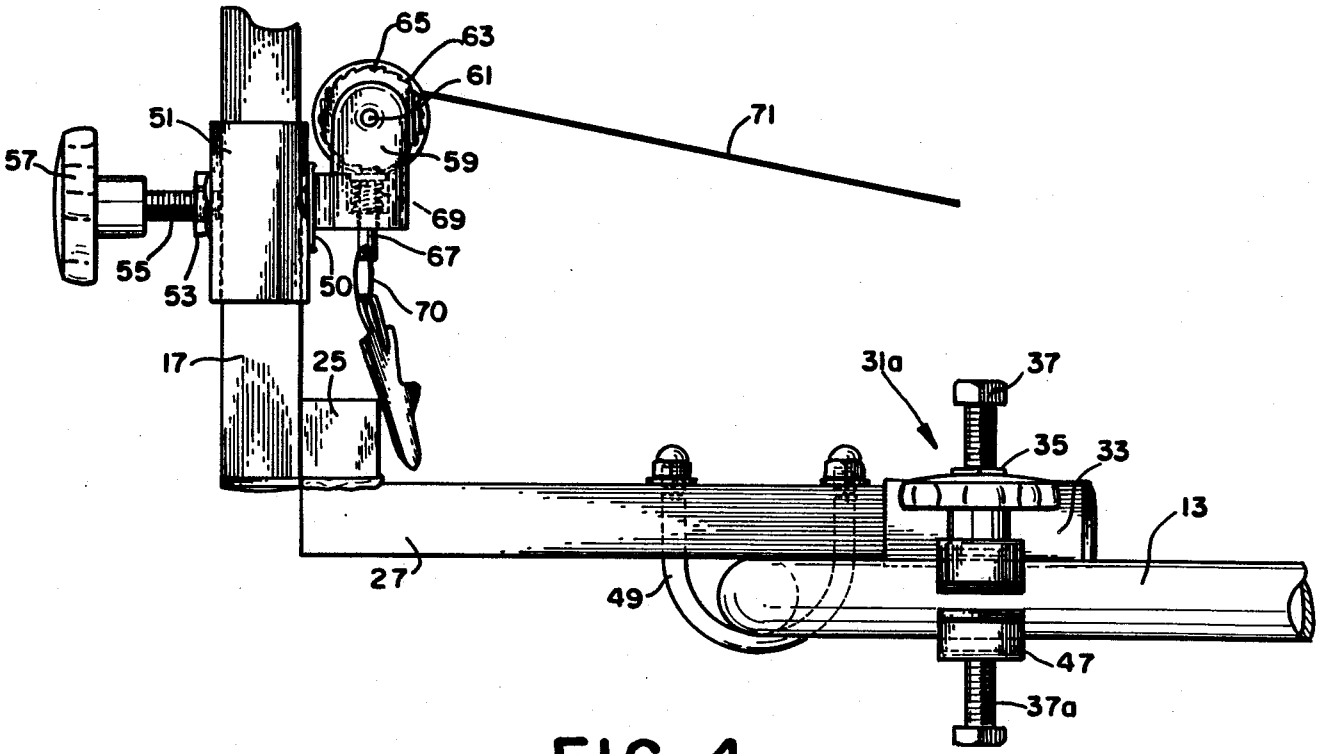
FIG. 4 is a partial view in elevation of the invention from the left side of FIG. 2.
Figure 5:
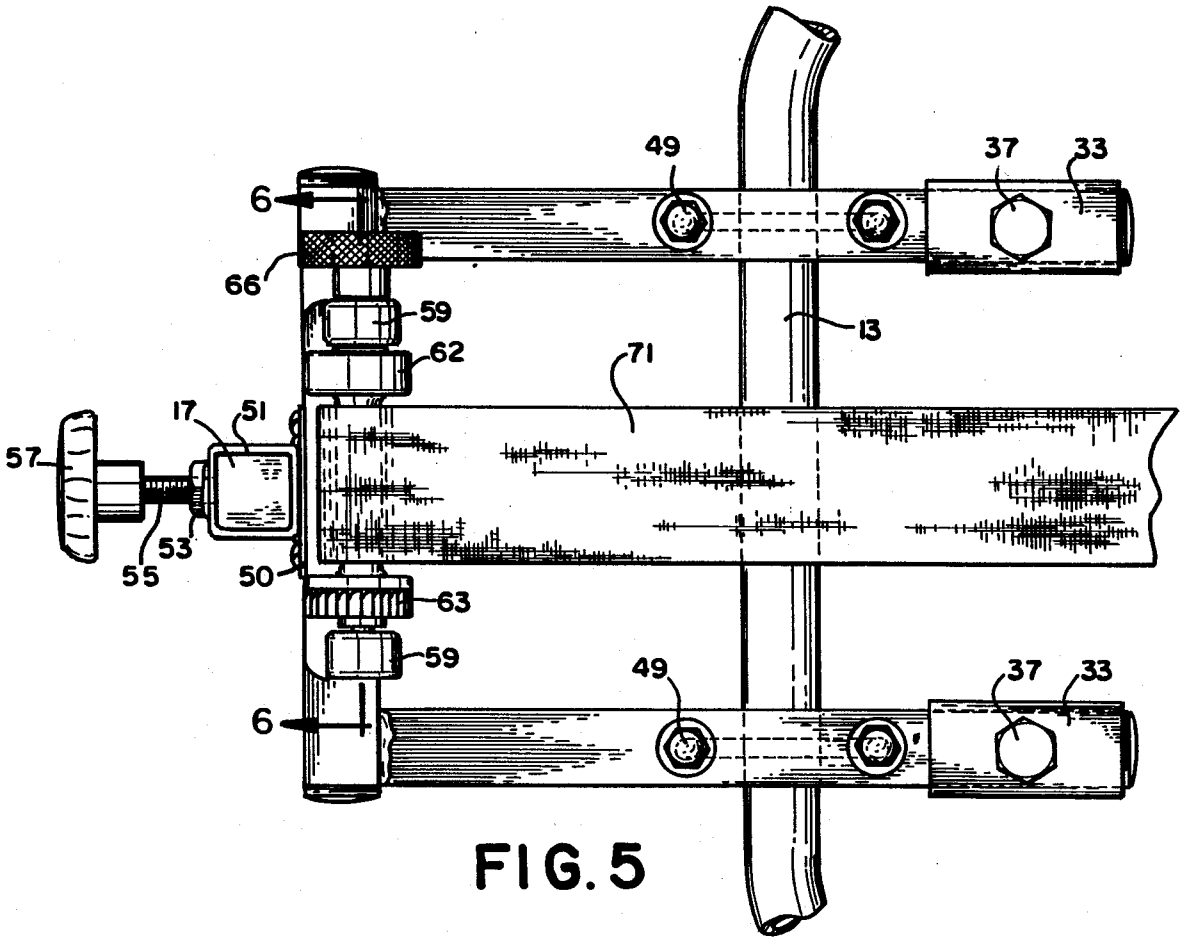
FIG. 5 is a partial view in top plan of the invention.
Figure 6:
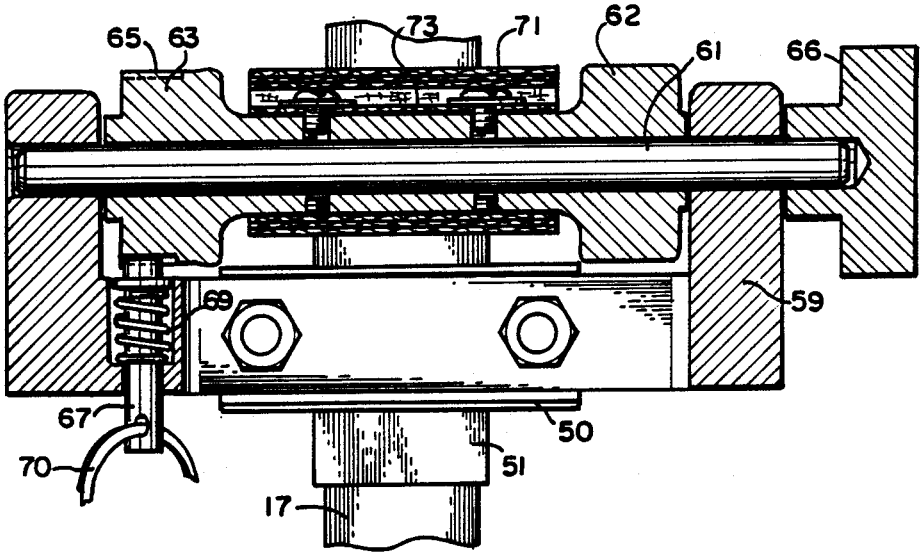
FIG. 6 is a partial view in section taken along the lines and arrows 6—6 of FIG. 5.

When looking at the invention from the left side of FIG. 2, as shown in FIG. 4, pin 67, when in contact with ratchet wheel teeth 65, blocks the unwinding of nylon strap 71 from spool 62 by blocking clockwise rotation of ratchet wheel 63. However, pin 67 does not block further winding of nylon strap 71 around spool 62 when greater traction is desired since pin 67 does not block counterclockwise rotation of ratchet wheel 63. During counterclockwise rotation of ratchet wheel 63 (again when looking at ratchet wheel 63 from the left as shown in FIG. 4), each ratchet wheel tooth 65 pushes pin 67 outwardly as the tooth 65 passes over pin 67.

Increases in the amount of traction being applied by traction device 11 are in gradual increments defined by the distance between adjacent ratchet wheel teeth 65.

The amount of traction being applied is monitored by looking at measuring device 21, and any adjustment in the amount of traction is easily made. By turning handle 66 to rotate rod 61 so that nylon strap 71 is further wound around spool 62, more traction is applied. If it is determined that the traction provided on the spine by device 11 should be discontinued or reduced, pin 67 may be pulled outwardly by pulling on ring 70 to disengage the upper end of pin 67 from contact with ratchet wheel 63. With pin 67 disengaged from contact with ratchet wheel 63, rod 61 is free to spin and nylon strap 71 may be unwound from spool 62.

Frame 15 and vertical bar 17 may be made of different materials other than aluminum, but such materials should be strong enough to handle the stress placed on device 11 due to traction while preferably being lightweight to facilitate its use in helicopters.

Although the embodiment of the invention shown in the drawings has base bar 25 welded to vertical bar 17, and legs 23 and 27, and bar 39 is connected to leg 23 by a sleeve device **31*a*, and bar 39 connected to leg 27 by a sleeve device 31*b*, the means for connecting the frame 15 together may be by welding alone, using a number of sleeve devices 31*a*, 31*b*** or any other appropriate means.

I claim:

1. A cervical traction device used with a stretcher, especially with the type of stretcher that is used for transporting trauma patients with spinal cord injuries by helicopter, for providing traction to an injured person having a fractured neck comprising a frame, attachment means for attaching the frame to the stretcher, traction means mounted on the frame for applying traction to the cervical spine of the injured person and for adjusting the amount of said traction, vertical adjustment means for adjustably securing the traction means at a desired position on the frame to allow vertical height adjustment of the traction means to obtain proper traction alignment with the injured person lying on the stretcher, said traction means consisting of an upwardly extending shaft mounted on the frame, a bracket mounted on the shaft, a second shaft mounted on said bracket, a ratchet wheel rotatably mounted on said second shaft, a movable pin mounted on the bracket and held in contact with the teeth of the ratchet wheel by a spring that is housed in the bracket, a strap having a first end portion and a second end portion, the first end portion of the strap being mounted on the shaft of the ratchet wheel, and connecting means for connecting the second end position of the strap to a patient, said connecting means including a connecting ring and an S-hook adapted to be connected to a tong that is secured to the head of the patient.

2. The cervical traction device of claim 1, further including a measuring device for measuring the traction applied to the cervical spine.

3. The cervical traction device of claim 1, said attachment means for attaching the frame to the stretcher including a first clamp attached to the frame that connects the frame to a rail of the stretcher, a second clamp attached to the frame that connects the frame to another rail of the stretcher, and a pair of U-bolts attached to the frame that engage the head rail of the stretcher to increase the stability of the device.

4. The cervical traction device of claim 1, the vertical adjustment means for adjustably securing the traction means at a desired position on the frame including a threaded bolt having a handle on its outer end, and having an inner end that presses against the frame and a nut mounted on a sleeve slideably mounted on the frame and through which the threaded bolt is screwed, whereby the threaded bolt may be screwed through the nut and sleeve into pressing contact with the frame to secure the sleeve at the desired position.

5. The cervical traction device of claim 2, the measuring device being a dial scale or a spring-loaded weight scale connected to the traction means for measuring the amount of traction being applied to the injured person.

6. A cervical traction device for use with a stretcher, especially with the type of stretcher that is used for transporting trauma patients with spinal cord injuries by helicopter, for providing traction to an injured person having a fractured neck comprising a frame having a U-shape with two parallel legs connected by a base portion and a vertical bar extending upwardly from the base portion, attachment means for attaching the frame to the stretcher, traction means for applying traction to the cervical spine of the injured person and for adjusting the amount of said traction, vertical adjustment means for adjustably securing the sleeve at a desired position on the vertical bar to allow vertical height adjustment of the sleeve to obtain proper traction alignment with the injured person lying on the stretcher, the traction means including a ratchet device mounted on the sleeve for applying traction to the cervical spine of the injured person and for adjusting the amount of said traction, the ratchet device including, a ratchet wheel rotatably mounted on a shaft in a bracket, a movable pin mounted on the bracket and held in contact with the teeth of the ratchet wheel by a spring that is housed in the bracket, a strap having a first end portion and a second end portion, the first end portion of the strap being mounted on the shaft of the ratchet wheel, a measuring device for measuring the traction applied to the cervical spine, a connecting ring connecting the second end portion of the strap to the measuring device, and an S-hook mounted at the end of the measuring device adapted to be connected to a tong that is secured to the head of the patient, the frame being made of aluminum and being hollow, said attachment means for attaching the frame to the stretcher including a first clamp attached to the frame that connects the frame to one side of the stretcher, a second clamp attached to the frame that connects the frame to another side of the stretcher, and a pair of U-bolts that engage the head rail of the stretcher to increase the stability of the frame, the vertical adjustment means for adjustably securing the traction means at a desired position on the vertical bar including a threaded bolt having a handle on its outer end, and having an inner end that presses against the vertical bar and a nut mounted on a sleeve slideably mounted on the frame and through which the threaded bolt is screwed, whereby the threaded bolt may be screwed through the nut and sleeve into pressing contact with the vertical bar to secure the sleeve at the desired position, the weight measuring device being a dial scale or a spring-loaded weight scale.

* * * * *